US010223913B2

(12) United States Patent
Bichon

(10) Patent No.: US 10,223,913 B2
(45) Date of Patent: Mar. 5, 2019

(54) TRAFFIC SIGNAL SNOW SHIELD

(71) Applicant: Christopher Neal Bichon, Glenwood Springs, CO (US)

(72) Inventor: Christopher Neal Bichon, Glenwood Springs, CO (US)

( * ) Notice: Subject to any disclaimer, the term of this patent is extended or adjusted under 35 U.S.C. 154(b) by 0 days.

(21) Appl. No.: 15/981,852

(22) Filed: May 16, 2018

(65) Prior Publication Data

US 2019/0027031 A1 Jan. 24, 2019

Related U.S. Application Data

(60) Provisional application No. 62/559,289, filed on Sep. 15, 2017, provisional application No. 62/534,412, filed on Jul. 19, 2017.

(51) Int. Cl.

| | |
|---|---|
| ***F21V 3/00*** | (2015.01) |
| ***G08G 1/095*** | (2006.01) |
| ***F21V 5/04*** | (2006.01) |
| *F21Y 115/10* | (2016.01) |
| *F21W 111/02* | (2006.01) |
| *F21Y 101/00* | (2016.01) |

(52) U.S. Cl.

CPC ..... *G08G 1/095* (2013.01); *F21V 5/048* (2013.01); *F21W 2111/02* (2013.01); *F21Y 2101/00* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 5,785,418 | A | 7/1998 | Hochstein |
| 9,581,308 | B2 | 2/2017 | Watkins |
| 2012/0119672 | A1 | 5/2012 | Meyer |

OTHER PUBLICATIONS

Snow Sentry Fortran, fortrantraffic.com http://www.fortrantraffic.com/shop/signals /snow-sentry-snw008/.

"Snow Scoop Visor," McCain ®, mccain-inc.com, https://www.mccain-inc.com/products/signals/signalaccessories/scoop-tunnel-visor.

"Safetran Systems CLS-20R Railroad Signal Light," https://www.ebay.com/itm/Safetran-Systems-CLS-20R-Railroad-Signal-Light-/282807541745.

Adreama,"Traffic light visor," adreama.blogspot.com http://adreama.blogspot.com/2012/06/traffic-light-visor.html.

*Primary Examiner* — Vip Patel

(74) *Attorney, Agent, or Firm* — Patent Law Offices of Rick Martin, P.C.

(57) ABSTRACT

An LED traffic signal is enhanced with a combination of a cylindrical opaque visor and a transparent cone that is placed over the lens. The visor is offset from the lens to provide a gap, an escape route for fast moving air that rushes down the cone and out the gap as described in the Bernoulli formula. Various embodiments include a wing shaped visor, a standard visor being cylindrical, and a custom visor being cylindrical.

20 Claims, 8 Drawing Sheets

TRAFFIC SIGNAL SNOW SHIELD

CROSS REFERENCE APPLICATIONS

This non-provisional application claims priority from provisional application Ser. No. 62534412 filed Jul. 19, 2017 and provisional application No. 62559289 filed Sep. 15, 2017, wherein both the aforementioned provisional applications are incorporated herein in their entireties by reference.

FIELD OF THE INVENTION

The present invention relates to traffic signal visors and shields that help prevent a snow buildup on an LED traffic light lens.

BACKGROUND

Traffic lights are well known and typically comprise a trio of lights aligned vertically. Depending on which light is illuminated, a motorist facing the light on an associated street is directed whether to proceed through an intersection, proceed with caution, or to stop and not enter the intersection. The ability for motorists to clearly see which of the three lights is illuminated from a distance is critical in ensuring the safe flow of traffic through an intersection.

To prevent the buildup of snow and ice on the colored lenses of the lights and to help shade the lights in bright sunlight, many traffic lights include visors (or fairings) that extend around the lights except for an opening at the bottom thereof to permit water to flow and snow to fall therefrom. Sometimes these visor enclosures have performed as desired.

In the past under certain circumstances, such as heavy snow storms with blowing snow, snow tended to build up in front of the lenses of prior art traffic signals; however, because the underlying lights were incandescent they gave off a significant amount of heat that melted the snow and prevented the lenses from becoming covered, thus maintaining suitable visibility.

In the recent past, state and federal government regulations have dictated that all traffic lights be changed over to brighter and presumably more visible LED type bulbs. Since LED lights are much more energy efficient than incandescent lights of similar output, they do not generate sufficient heat to melt snow that can accumulate on the lens in heavy snow storms.

A brief summary of some prior art references follows below.

Pub.No. U.S. 2012/0119672 to Meyer discloses a dome shaped shield placed at the outermost edge of a traditional visor.

U.S. Pat. No. 9,581,308 (2017) to Watkins discloses a cylindrical lens having a slanted convex front cutout, the lens fits around the LED traffic light. The slanted cutout supports a domed shield in front of the traffic light.

JP 2003109187A [Munesawa] discloses a display in which snowing on the surface of the display can be prevented, a light unit 5 A of a signal lighting having a hood 10 and a transparent snowing-proof plate 31 is arranged in front of this light unit 5A while being inclined forward. This snowing-proof plate 31 is incorporated inside the hood 10 through a packing 32, and a space 34 is formed from a transparent resin cover 6. Wind 36 is decelerated on the surface of the snowing-proof plate 31 air uniformly flows obliquely downward along with the relevant surface and blows out snow on the snowing-proof plate 31 (Abstract; FIG. 3).

U.S. Pat. No. 5,785,418 [Hochstein] discloses casing 42 surrounding the base 36 of the heat sink, and insulating material 44 is disposed between the base 36 and the casing 42 to limit heat transfer to the heat sink from outside the casing 42, i.e., from sources other than the LEDs 28. Transparent cover 46 is retained within the shell 38 by a weather seal 48, casing 14 defines a heat shield surrounding the thermally insulating material 44 to act as an additional barrier to heat transfer into the heat sink 36 (FIG. 8; Column 5, Lines 35-65; Claims 1-7).

The Following Non-Patent Literature Articles are Noted:

1. "SNOW SENTRY", Fortran, fortrantraffic.com, accessed: February 2018. http://www.fortrantraffic.com/shop/signals/snow-sentry-snw008/. Discloses a device that when installed over the led module reduces the potential build-up of snow and ice on lens.
2. "Snow Scoop Visor," McCain®, mccain-inc.com, accessed: February 2018. https://www.mccain-inc.com/products/signals/signalaccessories/scoop-tunnel-visor discloses advanced signal visors that combat snow buildup on signal lenses in cold climates, louvered. vent on top, coupled with an open bottom help funnel air across the face of the lens reducing snow accumulation.
3. "Safetran Systems CLS-20R. Railroad Signal Light," eBay, ebay.com, seller: wcartey, ebay item number: 282807541745, Feb. 8, 2018. https://www.ebay.com/itm/Safetran-Sytems-CLS-20R-Railroad-Signal-Light-/282807541745 discloses a traffic signal with an extended shield,
4. Adreama,"Traffic light visor," adreama.blogspot.com, Jun. 9, 2012. http://adreama.blogspot.com/2012/06/traffic-light-visor.html discloses set of drop-down visors which could be deployed for non-functioning traffic lights, could be remotely electronically developed, allowing rapid response to traffic light failure, would be on a separate circuit to avoid both the traffic lights and the visors being out of action simultaneously.

What is needed in the art is a Manual on Uniform Traffic Control Device (MUTCD) compliant wind accelerating traffic shield that uses ambient wind to form a high speed wind blower across the face of an LED traffic signal. The present invention places a transparent cone over the LED traffic signal lens. A cylindrical opaque wing or visor surrounds the peripheral base of the cone, thereby creating a Bernolli's effect wind across the traffic signal lens.

SUMMARY OF THE INVENTION

The main aspect of the present invention is to mount a transparent cone over an LED traffic signal, and surround the cone with a cylindrical shield, thereby using a Bernoulli effect to accelerate ambient wind toward the LED traffic signal and cause a vacuum in front of the LED traffic signal, thereby forcing snow on the LED traffic signal outbound away from the base of the cone.

Another aspect of the present invention is to enhance the vacuum in front of the LED traffic signal.

Another aspect of the present invention is to provide a retrofit kit to a prior art visor that mounts a cone inside the visor that forms the vacuum.

Another aspect of the present invention is to increase the time of freezing of the LED traffic signal by speeding up the flow of air across the LED traffic signal, thereby reducing the buildup of water on the LED traffic signal, wherein water captures snowflakes.

Another aspect of the present invention is to minimize any quick freezing on the LED traffic signal because in 5 to 15 minutes an LED traffic signal can freeze over causing accidents, and it takes hours for the frozen snow to melt, after ambient goes over 32° F.

Embodiments of an Improved Signal Fairing and Head

Embodiments of the present invention comprise an improved signal fairing and head configured to replace currently used visors. Advantageously, the design and configuration of the head prevents the buildup of snow and ice on the lens cover by directing the wind associated with a storm around the interior of an aerodynamic visor and transparent conical lens cover in such a manner as to blow any snow therefrom, and prevent it from settling on surfaces that would hinder the light's visibility.

Several embodiments are disclosed of a signal head for use with a traffic signal device incorporating an improved frustoconical fairing and conically shaped transparent lens cover. The fairing and lens cover are typically secured to a light fixture that utilizes an LED bulb. The design of the ring in combination with the lens cover act to prevent the bull of snow and ice over the lens of the light fixture that could cause the underlying light to be obscured even when illuminated, thereby not giving viewing motorists adequate notice as to what traffic has the right of way at an intersection.

One embodiment is best characterized by the following parts or components: (i) the light fixture, which typically includes an LED bulb; (ii) a fairing with an aerodynamically derived cross sectional profile; (iii) a conically shaped lens cover; and (iv) a plurality of screws and/or other fasteners to secure the fairing and lens cover to the light fixture.

The light fixture, itself, can be of a fairly conventional design comprising a housing having a socket to receive a light bulb at a back end including a means to connect electrically to the signal light assembly. The bulb can be of any suitable type but is typically a high powered LED bulb. LED bulbs are largely mandated by state and federal agencies for being both brighter and consuming far less power than legacy bulb technologies. The front end is typically characterized by a relatively large red, green or yellow colored lens. A flange and/or ring bracket is provided around the front edge of the body and is used to both hold the lens to the body and to provide a means for connecting a fairing to the light fixture. The bracket is also used to secure the lens cover to the light fixture.

The fairing includes a ring or other means to receive the fasteners at its distal end and extends forwardly therefrom comprising an expanding generally frustoconical shape. The bottom of the fairing is open with the opening having an extent of about 45 degrees but which can vary significantly.

The cross section of one embodiment of the fairing wall is aerodynamically configured having a rounded leading edge, a largely straight inside wall that is canted outwardly at a small angle and more significantly outwardly angled outer wall. The inside diameter of the fairing varies a relatively small amount from the distal end to the proximal end where it intersects with the leading edge, and the outside diameter variance is much more pronounced from the distal end to the proximal end. Accordingly, the fairing is much thicker proximate the leading edge intersection than it is proximate the distal end mounting ring. There is a gap provided between the light fixture and the distal end of the fairing. Typically threaded fasteners (screws) are distributed around the circumference of the light fixture mounting bracket and the fairing ring. These fasteners and associated hardware are used to both secure the fairing to the signal head assembly, as well as space the distal end of the fairing a predetermined distance from light fixture. A predetermined distance of about 0.375-1.25" inches is desirable, but other spacings can be used in variations.

The rounded leading edge creates an overpressure situation at the front of the fairing to slow down blowing snow and channel a significant portion of it over the outside of the fairing. The frustoconical shape exterior wall of the fairing helps create a low pressure area behind leading edge where low pressure vortices are created. The lower pressure helps pull the snow slowed down in front of the leading edge around the fairing rather than into it. The low pressure region also acts to help pull snow that has entered the interior of the fairing out through the bottom opening and through the gap between the fairing and the light fixture at the fairing's distal end.

The fairing can be made of any suitable material, however, lightweight materials are preferred given the relatively large volume of the fairing. In one variation the fairing can comprise a foam core having a plastic or fiberglass skin thereover providing light weight and the necessary strength.

The transparent conically shaped lens cover includes a circular flange extending from its distal outer edge. When installed the flange is compressed between the mounting bracket of the light fixture and the lens to hold it securely in place. The lens cover is made of any suitable transparent material but most typically it is comprised of a plastic, such as polycarbonate.

The conical shape acting in concert with the inside wall of the fairing causes the speed of any snow received into the fairing to increase as it penetrates deeper therein reducing the chance that the snow will settle on the surface of the lens cover or fairing inside wall. The increased speed also increases the pressure at the back of the fairing which pushes the snow out of the bottom of the fairing and through the gap between the fairing and the light fixture into the lower pressure region on the outside thereof.

A second embodiment is a kit that can take a standard visor, offset its base away from the LED lens, and add the cone. A third embodiment combines a custom visor with the cone.

Inventive Aspects

The various inventive aspects of embodiments of the signal head assembly and associated fairing and conical lens cover include but are not limited to the following:

A) A signal head assembly for a traffic signal, the assembly including a light fixture, a frustoconical fairing, and a conically-shaped lens cover wherein the fairing has a rounded leading edge and tapers in outside diameter towards a distal end.

B) The signal head assembly of (A) wherein there is a gap between the distal end of the fairing and the fight fixture.

C) The signal head assembly of (A) wherein the bottom of the fairing is open and has an extend of about 45 degrees plus or minus 15 degrees.

D) The signal head assembly of (B) wherein the fairing is attached to the light fixture by way of a plurality of elongated fasteners.

E) A fairing and lens cover combination configured to prevent the buildup of snow and ice over the lens of a light fixture that would otherwise obscure its visibility.

The method of using the signal head assemblies of (A)-(D) to prevent the buildup of snow over a light fixture lens in a snow storm.

G) The signal head assembly of (A) wherein the conical lens cover is secured to the light fixture by way of mounting bracket that also acts to secure the light fixture lens to light fixture.

H) The signal head assembly of (A) wherein the fairing is thicker proximate the leading edge than proximate the distal end.

Other aspects of this invention will appear from the following description and appended claims, reference being made to the accompanying drawings forming a part of this specification wherein like reference characters designate corresponding parts in the several views.

These and other features and advantages of the Traffic Signal Snow Shield reside in the construction of parts and the combination thereof, the mode of operation and use, as will become more apparent from the following description, reference being made to the accompanying drawings that form a part of this specification wherein like reference characters designate corresponding parts in the several views. The embodiments and features thereof are described and illustrated in conjunction with systems, tools and methods which are meant to exemplify and to illustrate, not being limiting in scope.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE DRAWINGS

Figure 1A:
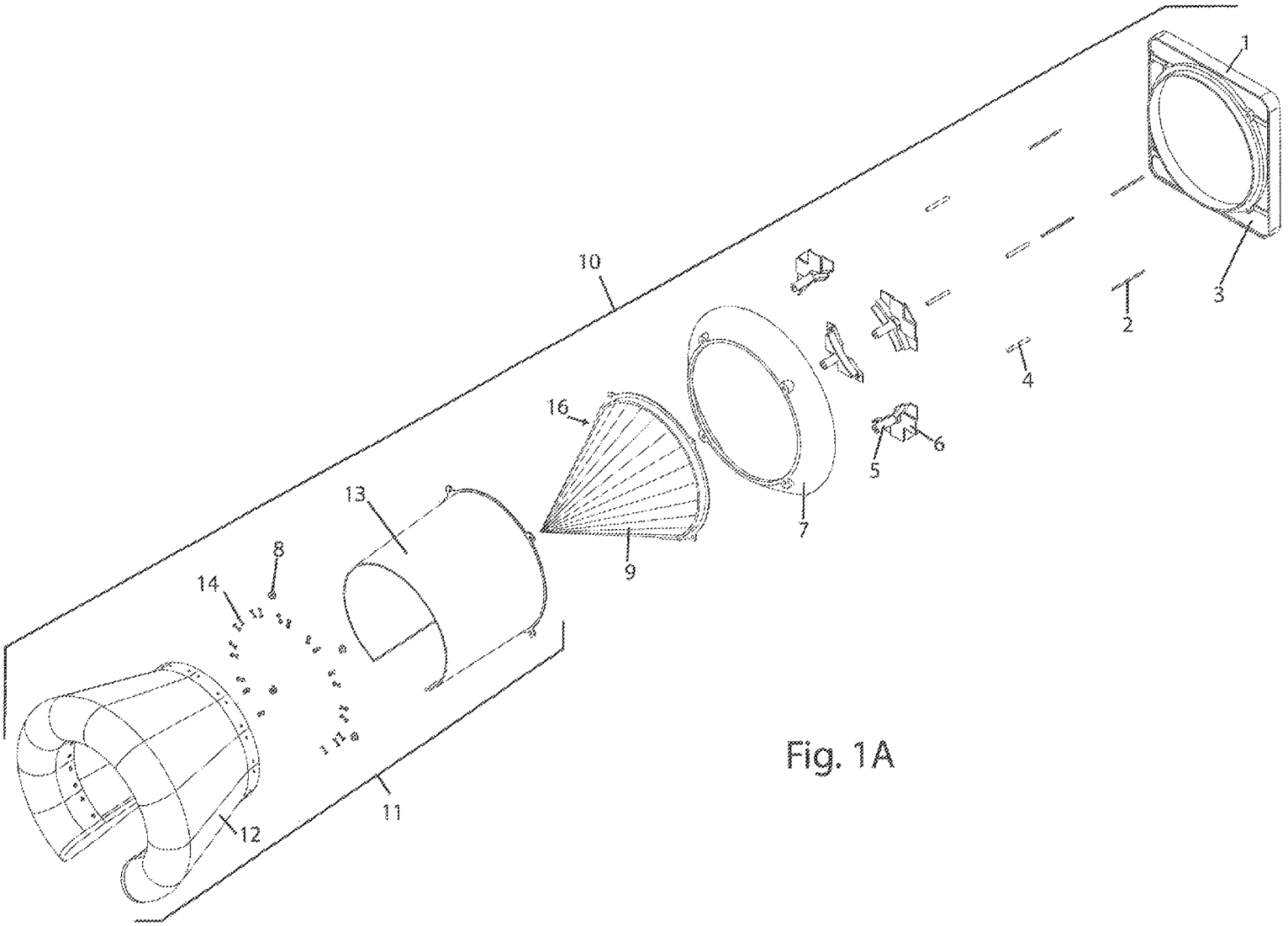
FIG. 1A is an exploded view of a first embodiment snow shield.
Figure 1B:
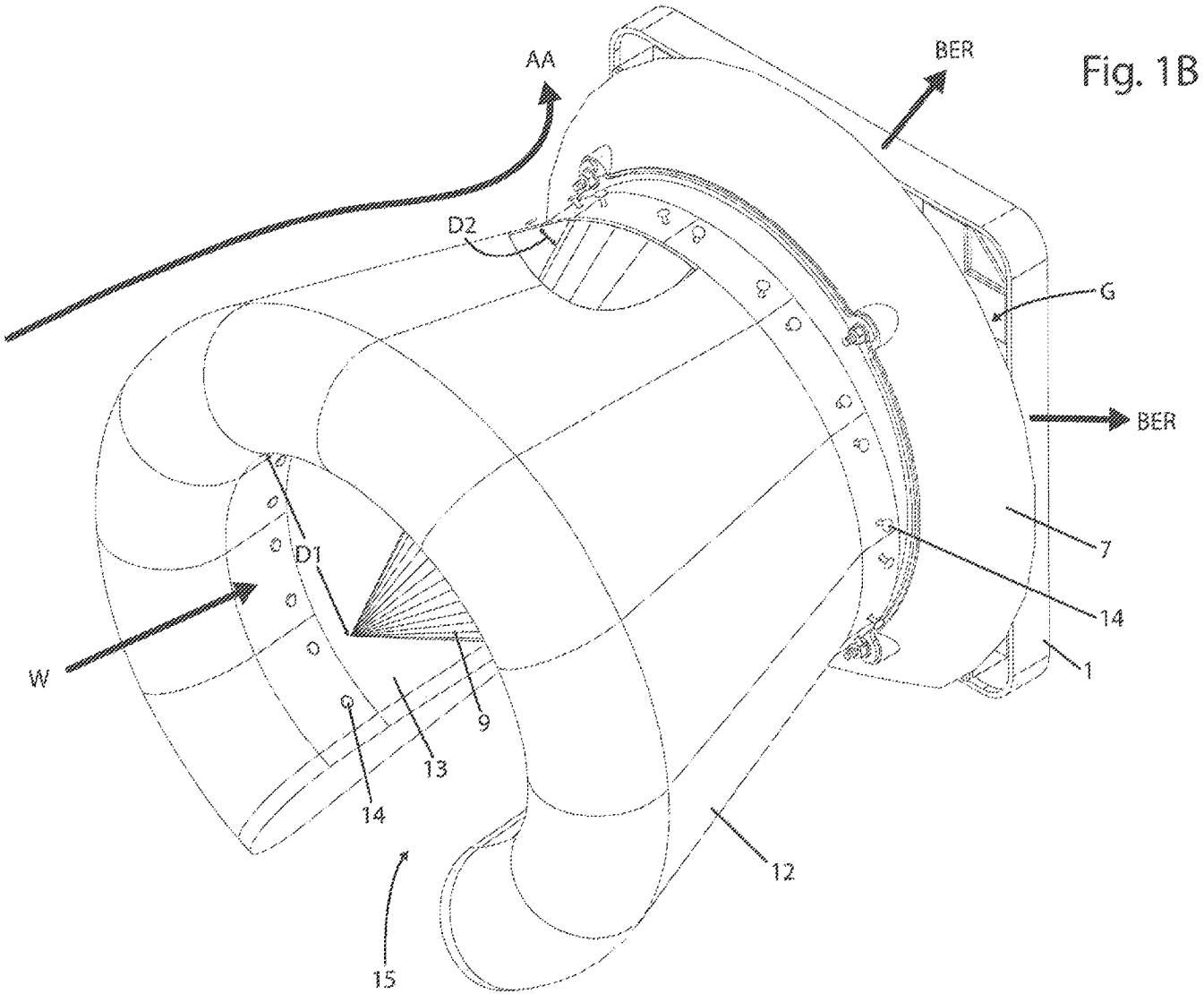
FIG. 1B is a front perspective view of the first embodiment snow shield.
Figure 2:
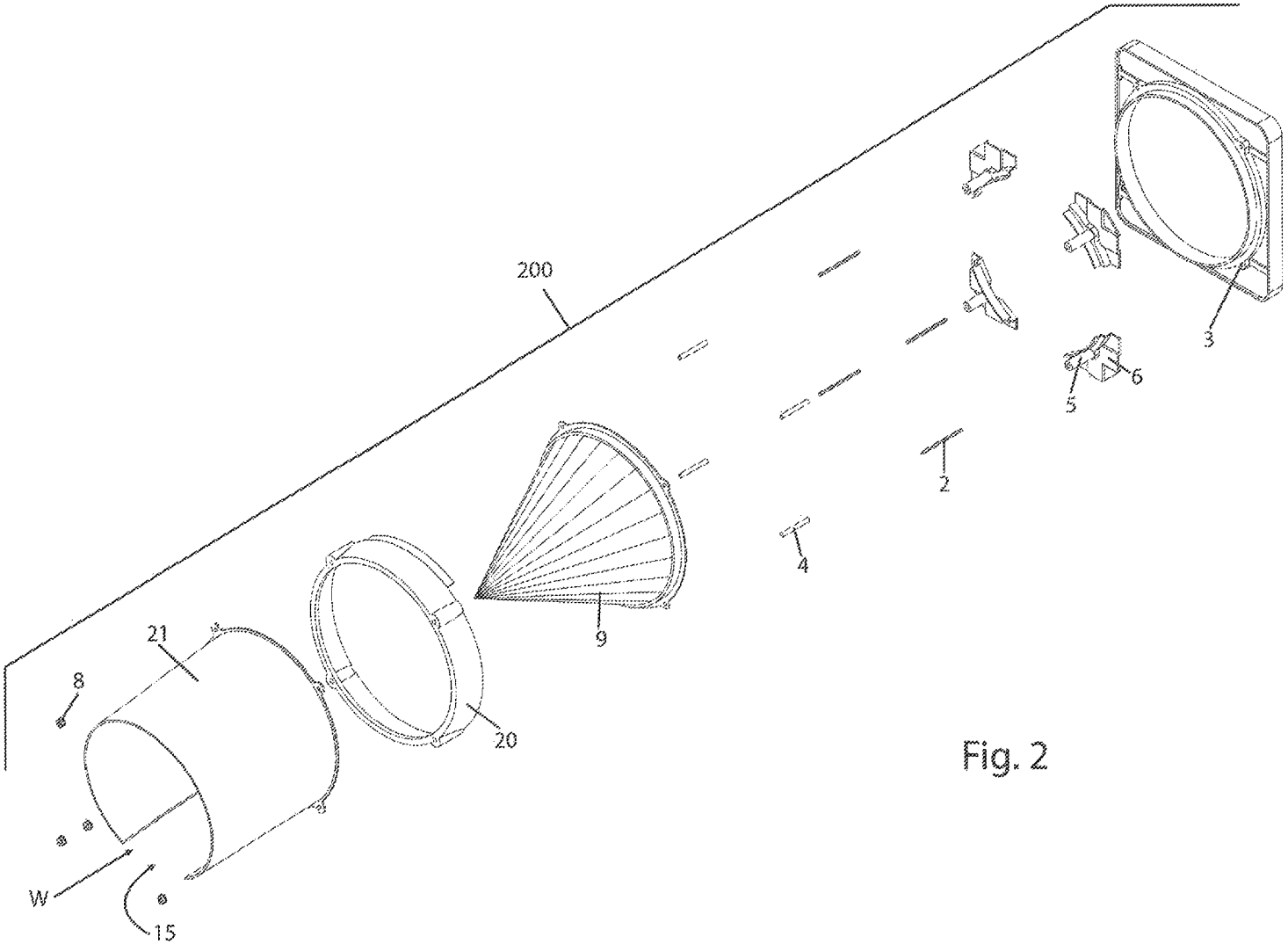
FIG. 2 is an exploded view of a second embodiment snow shield.

Referring first to FIGS. 1A, 1B a snow shield is labeled 10. A prior art LED bulb base 1 is square. A bulb (not shown) is convex within the base 1. Mounting posts 2 are secured in holes 3 of the base 1. Cylindrical collars 4 slide over posts 2, and the collar supports 5 of the standoffs 6 slide over the collars 4. The collar 7 is mounted on the supports 5 via nuts 8 that thread onto posts 2. The standoffs 6 form a gap G (about ⅝ inch) between the base 1 and the collar 7. The snow slot is labeled 15.

The cone 9 affixes to the collar 7 via posts 2 and nuts 8. The cone 9 is transparent and preferably plastic. The wing assembly 11 consists of an outer wing shaped (plastic) shroud 12 having a cylindrical inner wall 13 secured with rivets 14. The nut 8 secures all items 12,13,9,7 to the posts 2.

The incoming wind W enters the shroud 12 (which can be 3 to 4 inches wide) with a wide distance d1 between the inner wall 13 and the cone 9. The wind W is then forced into a narrow distance d2 between the inner wall 13 and the base 16 of the cone 9, and the wind is accelerated by the Bernoulli principle to exit the gap G as shown by arrows BER. This accelerating air BER forms a vacuum across the lens in the base 1 which removes any snow from the lens. The cone 9 can be about 11 inches tall with a 45 degree flange. The shroud 12 extends about one inch beyond the cone 9. The snow shield 10 is designed to withstand winds of up to 100 mph. The base 1 is a square 13 inches a side with a standard lens diameter of 11.4 inches. The wind travelling along the outside of wing 12 is shown by arrow AA. It can add to the force of the vacuum at the surface of the lens.

Bernoulli's Principle

Fluid dynamics, Bernoulli's principle states that an increase in the speed of a fluid occurs simultaneously with a decrease in pressure or a decrease in the fluid's potential energy. The principle is named after Daniel Bernoulli who published it in his book *Hydrodynamica* in 1738. Although Bernoulli deduced that pressure decreases when the flow speed increases, it was Leonhard Euler who derived Bernoulli's equation in its usual form in 1752. The principle is only applicable for isentropic flows: so when the effects of irreversible processes (like turbulence) and non-adiabatic processes (e. g. heat radiation) are small and can be neglected. Bernoulli's principle can be applied to various types of fluid flow, resulting in various forms of Bernoulli's equation; there are different forms of Bernoulli's equation for different types of flow. The simple form of Bernoulli's equation is valid for incompressible flows (e.g. most liquid flows and gases moving at low Mach number). More advanced forms may be applied to compressible flows at higher Mach numbers. Bernoulli's principle can be derived from the principle of conservation of energy. This states that, in a steady flow, the sum of all forms of energy in a fluid along a streamline is the same at all points on that streamline. This requires that the sum of kinetic energy, potential energy and internal energy remains constant Thus an increase in the speed of the fluid—implying an increase in its kinetic energy (dynamic pressure)—occurs with a simultaneous decrease in (the sum of) its potential energy (including the static pressure) and internal energy. If the fluid is flowing out of a reservoir, the sum of all forms of energy is the same on all streamlines because in a reservoir the energy per unit volume (the sum of pressure and gravitational potential p g h) is the same everywhere Bernoulli's principle can also be derived directly from Isaac Newton's Second Law of Motion. If a small volume of fluid is flowing horizontally from a region of high pressure to a region of low pressure, then there is more pressure behind than in front. This gives a net force on the volume, accelerating it along the streamline. Fluid particles are subject only to pressure and their own weight. If a fluid is flowing horizontally and along a section of a streamline, where the speed increases it can only be because the fluid on that section has moved from a region of higher pressure to a region of lower pressure; and if its speed decreases, it can only be because it has moved from a region of lower pressure to a region of higher pressure. Consequently, within a fluid flowing horizontally, the highest speed occurs where the pressure is lowest, and the lowest speed occurs where the pressure is highest.

Figure 8:
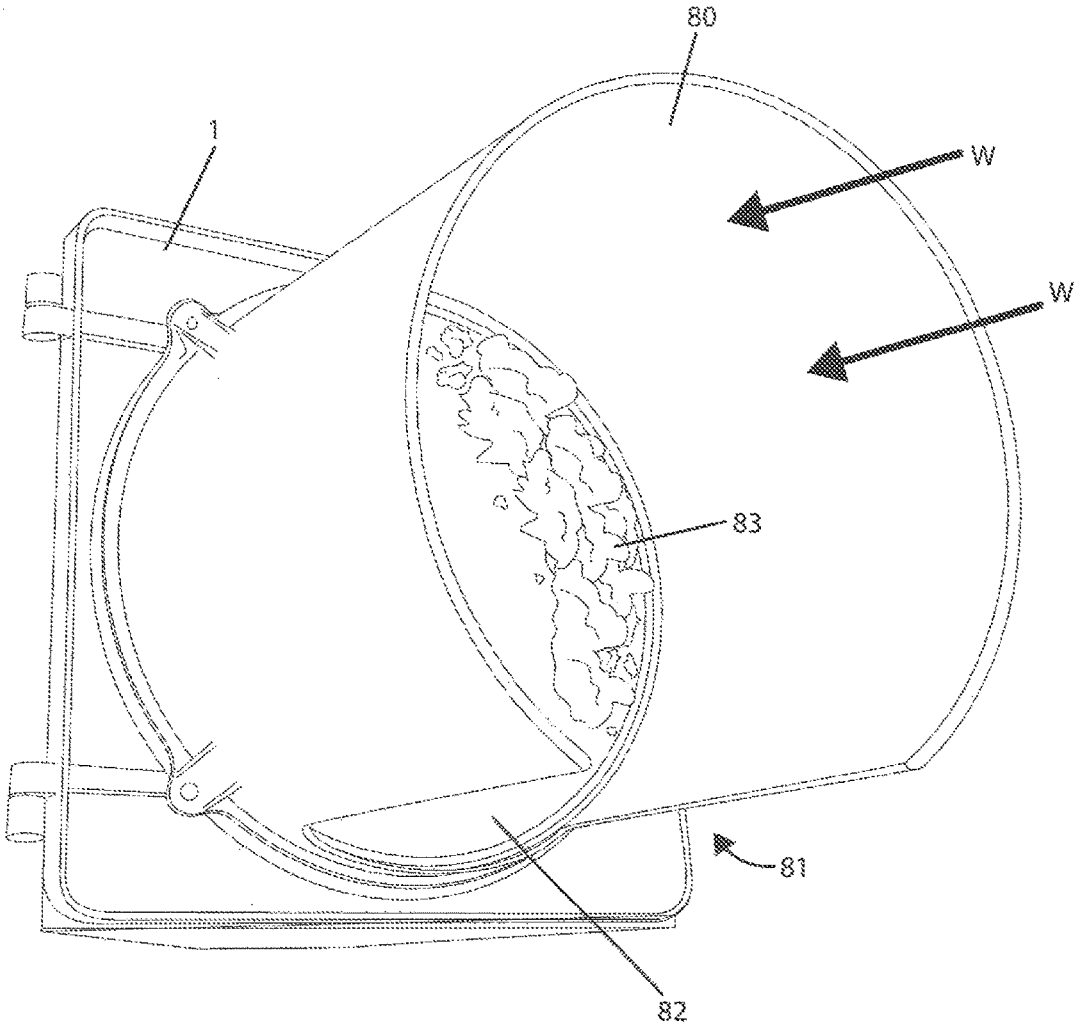
Fig. 8 (PRIOR ART)
FIG. 8 (prior art) is a front perspective view of a snow buildup on an LED lens.

Referring next to FIG. 8 (prior art) he base 1 has lens 82. A standard shroud 80 has the typical snow slot 81. The wind W carries snow with it which sticks on the cold surface of the lens as labeled 83 outbound as shown in FIG. 1B arrows BER.

Referring next to FIGS. 2-7 the snow shield 200 mounts on the same prior art base 1. A mounting ring 20 secures the cone 9 to the base 1. The shroud 21 is cylindrical having the snow slot 15.

Figure 3:
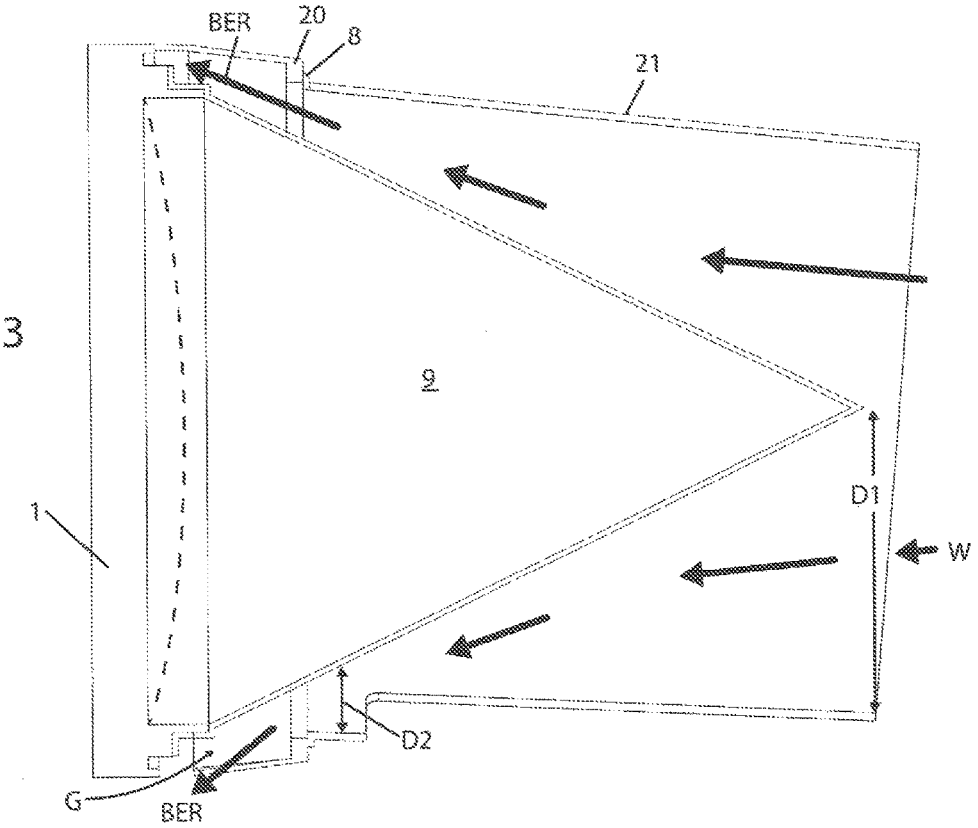
FIG. 3 is a longitudinal sectional view of the FIG. 2 embodiment.
Figure 4:
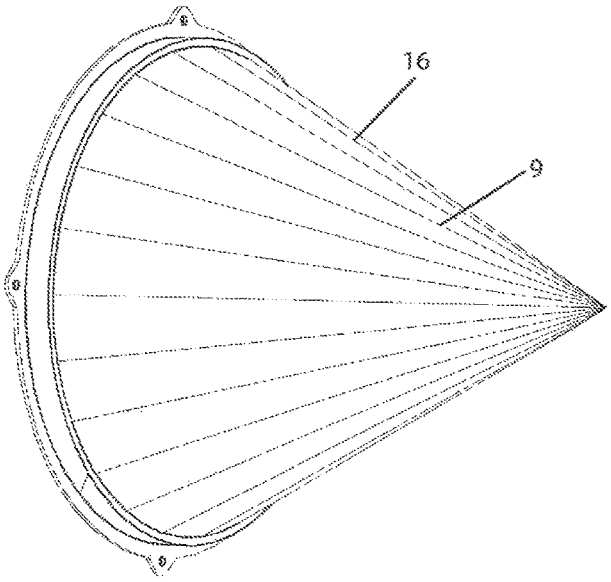
FIG. 4 is a front perspective view of the cone.
Figure 5:
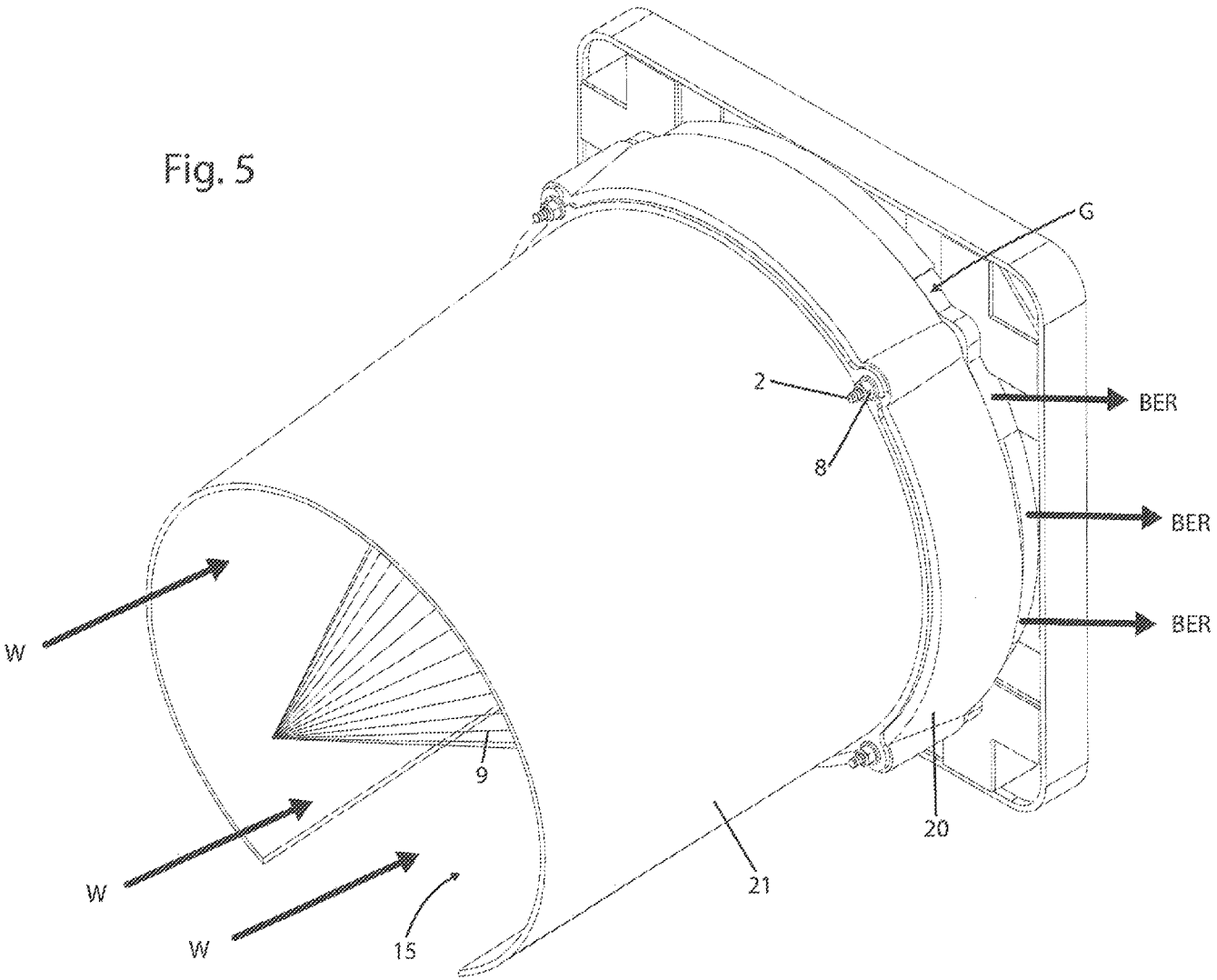
FIG. 5 is a front perspective view of the FIG. 2 embodiment.
Figure 6:
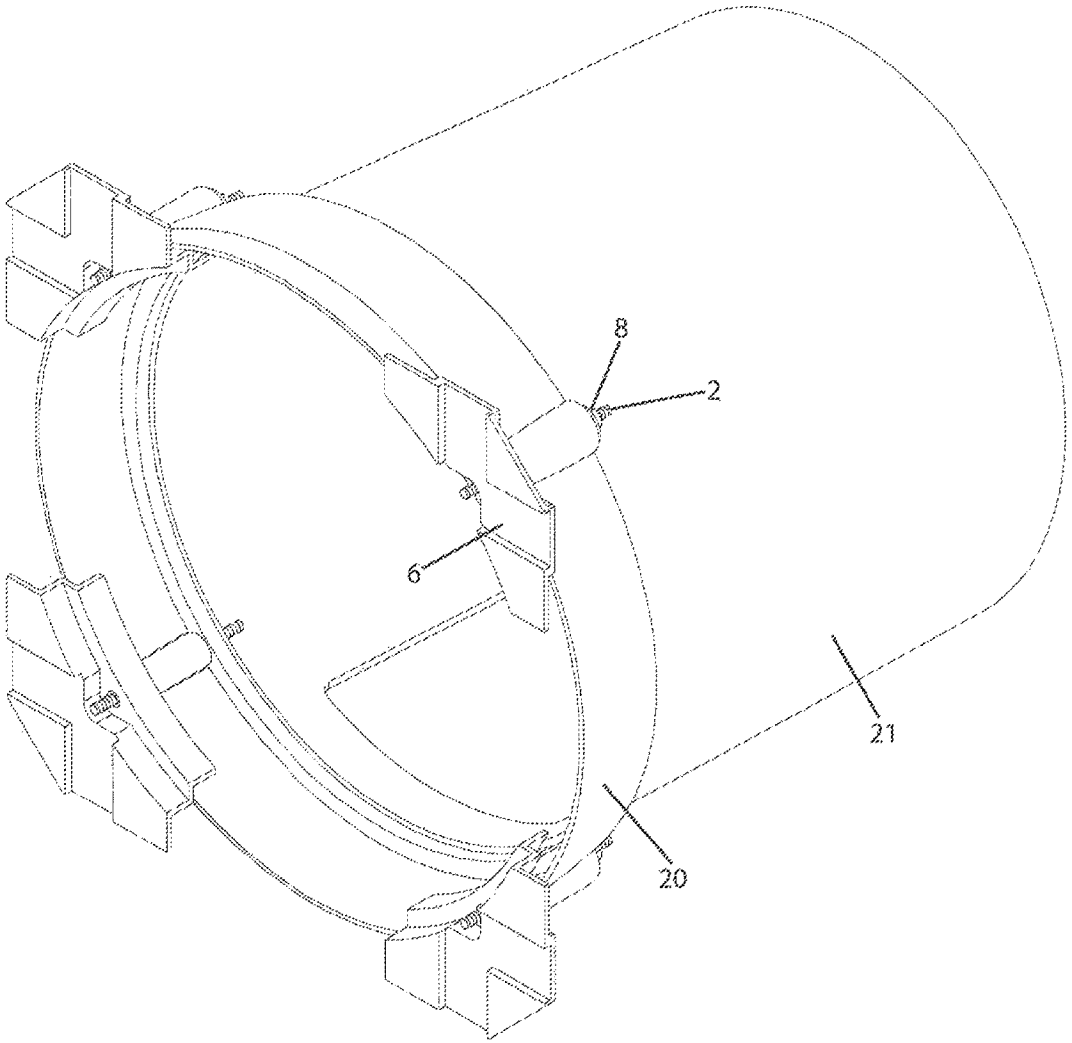
FIG. 6 is a rear perspective view of the FIG. 2 embodiment.
Figure 7:
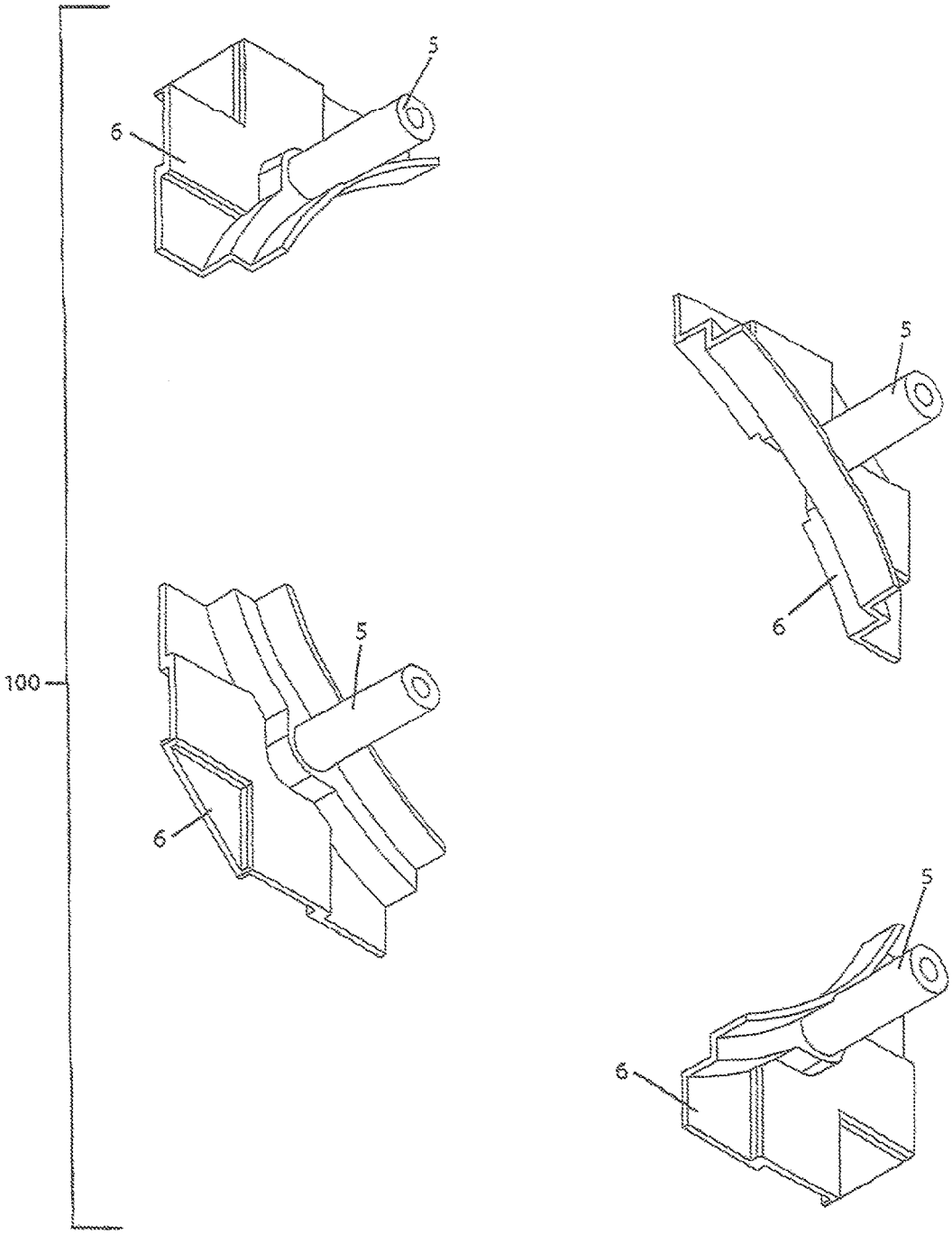
FIG. 7 is a front perspective view of the standoffs.

FIG. 3 shows the Bernoulli's principle of the air traveling from a wide diameter passageway d1 to a narrow passageway d2 to egress from the base 1 via gap G as shown by arrows BER. Gap G can range from about ¼ inch to about ¾ inch.

While a number of exemplifying features and embodiments have been discussed above, those of skill in the art will recognize certain modifications, permutations, additions and subcombinations thereof. No limitation with respect to the specific embodiments disclosed herein is intended or should be inferred.

I claim:

1. A traffic signal having an LED light with a forward facing lens, an improvement comprising:

an opaque cylindrical visor mounted around a peripheral edge of the lens at a chosen distance outbound above the lens;

wherein a gap is formed between the peripheral edge of the lens and a rear edge of the opaque cylindrical visor;

a transparent cone mounted co-axial with a central axis of the lens inside the opaque cylindrical visor;

said transparent cone having a circular base around the peripheral edge of the lens and having a pointed tip facing outbound from the lens; and wherein wind carrying snowflakes follows Bernoulli's principle and accelerates from the pointed tip of the cone, down an outside profile of the cone and out the gap, thereby urging snowflakes off the lens by drawing air across the lens by forming a vacuum around the lens.

2. The traffic signal of claim 1, wherein the pointed tip extends out from the lens about a same distance as a forward peripheral edge of the visor.

3. The traffic signal of claim 1, wherein the transparent cone is made of a plastic.

4. The traffic signal of claim 1, wherein the opaque cylindrical visor further comprises a standoff brace that is connected to the traffic signal and supports the opaque visor the chosen distance outbound above the lens.

5. The traffic signal of claim 1, wherein a plurality of posts are mounted on the traffic signal, and the opaque cylindrical visor and the cone and a mounting collar for the cone and a plurality of standoffs for the cone are mounted on the plurality of posts.

6. The traffic signal of claim 1, wherein the pointed tip extends out from the lens about a half inch less as a forward peripheral edge of the visor.

7. The traffic signal of claim 1, wherein the cone has a height of about eleven inches.

8. The traffic signal of claim 1, wherein the gap has a height ranging from about ¼ inch to about ¾ inch.

9. An outdoor traffic signal comprising:

an LED lamp with a lens;

a visor mounted above the traffic signal forming a gap between a rear peripheral edge of the visor and the lens;

a transparent cone mounted inside the visor and co-axial with the visor and the lens, and sharing the same gap; and wherein a wind entering the visor accelerates out the gap to form a vacuum around the lens which forces an air bundle at ambient air pressure on the lens out the gap as the air bundle travels to the vacuum around the lens.

10. The traffic signal of claim 9, wherein the transparent cone is supported on the traffic signal on a standoff, and a collar secures a base of the cone to the traffic signal, and the visor attaches to the collar.

11. The traffic signal of claim 9, wherein the cone has a tip extending about 11 inches from the traffic signal.

12. The traffic signal of claim 9, wherein the gap has a height ranging from about ¼ inch to about ¾ inch.

13. The traffic signal of claim 9, wherein the transparent cone has a circular base surrounding a circular peripheral edge of the lens.

14. The traffic signal of claim 9, wherein the visor further comprises an outside contoured surface in a shape of a wing having a wider leading edge than a narrower trailing edge.

15. A traffic signal comprising:

a lamp having a lens;

a base surrounding the lens;

a transparent cone mounted on the base axially aligned with the lens at a gap above the lens and covering the lens;

a visor surrounding the cone; and wherein air entering the visor accelerates down the cone out the gap.

16. The traffic signal of claim 15, wherein the visor is cylindrical.

17. The traffic signal of claim 15, wherein a standoff supports the transparent cone above the lens to form the gap.

18. The traffic signal of claim 17, wherein the gap ranges from about ¼ inch to about ¾ inch.

19. The traffic signal of claim 18, wherein the transparent cone has a height ranging from about 9 inches to about 13 inches.

20. The traffic signal of claim 19, wherein the cone height is about 11 inches.

* * * * *